US009839272B2

(12) United States Patent
Licciardino

(10) Patent No.: US 9,839,272 B2
(45) Date of Patent: Dec. 12, 2017

(54) COMPOSITE LUGGAGE PROTECTION ASSEMBLY

(71) Applicant: Mario Licciardino, Highland Beach, FL (US)

(72) Inventor: Mario Licciardino, Highland Beach, FL (US)

( * ) Notice: Subject to any disclaimer, the term of this patent is extended or adjusted under 35 U.S.C. 154(b) by 1053 days.

(21) Appl. No.: 14/012,032

(22) Filed: Aug. 28, 2013

(65) Prior Publication Data

US 2016/0331093 A1 Nov. 17, 2016

Related U.S. Application Data

(63) Continuation of application No. 13/714,608, filed on Dec. 14, 2012, now abandoned.

(51) Int. Cl.

| | |
|---|---|
| ***A45C 13/02*** | (2006.01) |
| ***A45C 13/00*** | (2006.01) |
| ***A45C 5/14*** | (2006.01) |
| ***A45C 13/10*** | (2006.01) |
| ***A45C 13/38*** | (2006.01) |

(52) U.S. Cl.

CPC ..... *A45C 13/002* (2013.01); *A45C 5/14* (2013.01); *A45C 13/103* (2013.01); *A45C 13/385* (2013.01)

(58) Field of Classification Search

CPC ..... A45C 13/02; A45C 13/002
USPC ..... 190/26, 101, 903; 70/63, 69, 80, 72, 76; 383/5, 61.1, 61.3
See application file for complete search history.

(56) References Cited

U.S. PATENT DOCUMENTS

| | | | | | |
|---|---|---|---|---|---|
| 2,030,360 | A | * | 2/1936 | Dyer | A45C 13/103 190/117 |
| 2,518,973 | A | | 8/1950 | Atherton | |
| 2,693,259 | A | * | 11/1954 | Amick | A45C 13/002 190/26 |
| 2,710,083 | A | | 6/1955 | White | |
| 2,759,577 | A | | 8/1956 | White | |
| 2,937,016 | A | | 5/1960 | Westman | |
| 3,090,454 | A | | 5/1963 | Farrar et al. | |
| 3,971,458 | A | * | 7/1976 | Koenig | A44B 19/301 190/120 |
| 3,998,304 | A | * | 12/1976 | Edgerton, Jr. | A45C 3/00 190/107 |

(Continued)

FOREIGN PATENT DOCUMENTS

| | | |
|---|---|---|
| GB | 2147497 | 5/1985 |
| WO | 9400034 | 1/1994 |

(Continued)

*Primary Examiner* — Sue A Weaver
(74) *Attorney, Agent, or Firm* — Malloy & Malloy, P.L.

(57) ABSTRACT

A composite luggage protection assembly is structured to protect a piece of luggage during transit, stowage, and/or storage, and includes a piece of luggage having a luggage protection assembly mounted thereto. The luggage protection assembly includes an external closure assembly structured and disposed to overlay at least a portion of a primary closure mechanism which maintains a cover of the luggage piece in a closed orientation, thereby restricting access into the piece of luggage and, more importantly, preventing access to the person's personal property therein. The luggage piece of the composite luggage assembly may include a mobile luggage piece, once again, having a luggage protection assembly operatively attached thereto.

15 Claims, 7 Drawing Sheets

(56) References Cited

U.S. PATENT DOCUMENTS

| | | | | |
|---|---|---|---|---|
| 4,175,604 | A * | 11/1979 | Bonner | B65D 33/34 383/120 |
| 5,140,833 | A | 8/1992 | Whalen | |
| 5,154,332 | A * | 10/1992 | Williams | A45F 3/04 190/26 |
| 5,170,826 | A | 12/1992 | Carstensen et al. | |
| 6,338,260 | B1 * | 1/2002 | Cousins | A45C 13/10 190/120 |
| 6,637,562 | B2 | 10/2003 | Oh | |
| 7,077,251 | B1 | 7/2006 | Gaither | |
| 7,093,699 | B2 * | 8/2006 | Yu | A45C 13/002 150/154 |
| 7,155,881 | B1 * | 1/2007 | McGuire | A45C 3/10 190/101 |
| 7,458,452 | B2 * | 12/2008 | Beakey | A45C 13/002 150/105 |
| 8,485,329 | B1 | 7/2013 | Roy et al. | |
| 8,766,111 | B2 | 7/2014 | Lee | |
| 8,853,565 | B2 | 10/2014 | Kritzler | |
| 9,080,910 | B1 | 7/2015 | Zyman Beer et al. | |
| 2004/0206431 | A1 | 10/2004 | Metzig et al. | |
| 2005/0051247 | A1 | 3/2005 | Johnson | |
| 2007/0056779 | A1 | 3/2007 | Laniado et al. | |
| 2007/0193786 | A1 | 8/2007 | Pohl et al. | |
| 2008/0011568 | A1 | 1/2008 | Siwak et al. | |
| 2008/0202878 | A1 * | 8/2008 | Looram | A45C 13/10 190/101 |
| 2009/0188820 | A1 | 7/2009 | McGrail et al. | |
| 2010/0270115 | A1 * | 10/2010 | Seamon | A45C 13/002 190/26 |
| 2012/0186926 | A1 | 7/2012 | Sheikh | |
| 2013/0192728 | A1 | 8/2013 | Duncan | |
| 2015/0067999 | A1 * | 3/2015 | Stefanek | A41D 27/245 27/28 |

FOREIGN PATENT DOCUMENTS

| | | |
|---|---|---|
| WO | 2009063269 | 5/2009 |
| WO | 2011007161 | 1/2011 |

* cited by examiner

COMPOSITE LUGGAGE PROTECTION ASSEMBLY

CLAIM OF PRIORITY

The present application is a continuation-in-part application of previously filed, application having Ser. No. 13/714,608, filed on Dec. 14, 2012 now abandoned, and incorporated herein by reference.

BACKGROUND OF THE INVENTION

Field of the Invention

This invention is directed to a composite luggage protection assembly including a luggage piece having a primary closure mechanism, and a luggage protection assembly affixed to the luggage piece. The luggage protection assembly comprises an external closure assembly structured and disposed in a covering relation to at least a portion of said primary closure mechanism, when the external closure assembly is disposed in a closed configuration.

Description of the Related Art

With increased travel of modern day society, there is a recognized need for covers to protect the outer surfaces of luggage during use, especially in dealing with commercial carriers. At present, luggage may be provided with custom tailored covers which are frequently very expensive. On the other end of the economic spectrum, some individuals have resorted to covering luggage pieces in plastic wrap and then taping the cover in place. Obvious problems exist with this latter protective technique relating to providing access to the interiors of the luggage during inspection procedures.

Some manufacturers have provided less expensive covers designed for their particular kind of luggage. However, because there is no standard dimension of many luggage pieces, these covers could not be used for the luggage of other manufacturers. Furthermore, various suppliers of luggage covers or protectors find it inconvenient to carry a large inventory represented by different types, dimensions and configurations of luggage covers, thereby making it difficult to obtain an appropriate protective cover.

Over the years, luggage protectors have been developed to shield items of baggage and the like to protect them from the weather and from marring, scratching or other type damage which may typically occur on commercial carriers, as set forth above. As also set forth above, commercial availability of such protective covers is not common. This may be due to the complicated nature and/or the configuring or sizing of cover structures to accommodate various styles of luggage pieces. For example, when a passenger's luggage must be opened for airport inspection, as is currently required before boarding planes and other commercial carriers, access to the luggage piece may be required. However, the attachment and removal of conventional or make-shift cover structures to accomplish such inspection is difficult, time consuming and serves to delay the overall inspection process.

The above set forth problems are increased due to the fact that in recent years there has been a proliferation of luggage types, styles, materials and designs, specifically including mobile luggage. Purchase of luggage frequently requires significant investment due to the expensive materials and intricate construction. Luggage that meets the traveler's needs for lightweight construction and/or organized packing frequently is more subject to damage from handling during the traveling procedure. By way of example only, flexible material bags and other soft sided luggage are often caught, snagged or torn by automatic baggage handling equipment.

All of the above noted problems have been compounded due to the fact that modern day society frequently uses the aforementioned "mobile luggage" wherein a luggage piece includes a wheel or roller assembly on one end thereof. The opposite end of such mobile luggage includes one or more handles, at least one of which is extendable outward to facilitate the pulling, pushing or other manipulation of the luggage piece during the movable transport over a supporting surface.

Therefore, in light of the above noted problems and disadvantages associated with self-made, conventional or commercially available luggage protective covers there is a need in this art for a luggage protection assembly which is readily usable with a variety of luggage types and designs. In addition the versatility of such a proposed luggage piece should be such as to render it readily adaptable for protective retention of mobile luggage pieces of the type set forth above.

In doing so a preferred and proposed luggage protecting assembly should accommodate the rolling support such as wheels, rollers, etc., of a variety of different luggage styles as well as the location and structure of the handles thereof, while maintaining a secure retention and protection of the luggage piece on interior portions thereof.

Further, the mounting and removal of such a proposed luggage protection assembly should be easily and quickly accomplished thereby enabling inspection of the luggage piece and its contents, when necessary by authorized personnel. Moreover, the material from which the luggage cover is formed can serve to protect the closed and retained luggage piece from damage of all types and be readily acceptable to x-ray and other inspection equipment through which luggage typically passes such as at modern airport facilities.

A further advantage may be realized by providing a piece of luggage having a luggage protection assembly attached thereto. The luggage protection assembly may be removably attached to the piece of luggage, or it may be integrally constructed with the luggage piece.

SUMMARY OF THE INVENTION

The present invention is directed to an assembly structured to protect a piece of luggage including a piece of mobile luggage which includes a wheel assembly or other type of rolling or mobile support. As conventionally used and structured, mobile luggage includes at least one extendible handle, selectively disposable between a retracted or collapsed position and an outwardly extended, operative position. When so extended, the handle facilitates the pulling of the mobile luggage piece as the mobile or rolling support moves over the supporting surface.

It is emphasized that the protection assembly of the present invention, in each of its plurality of different embodiments, may be used with conventional or non-mobile luggage. However, structural and operative features associated with the various preferred embodiments facilitate its use with a mobile piece of luggage in a manner which does not require alteration, repositioning or modification of the mobile luggage piece or the protection assembly of the present invention.

More specifically, the luggage protection assembly of the present invention comprises a housing which may be formed from a flexible, semi-flexible, semi-rigid, or substantially rigid material. Further, the housing includes a hollow interior dimensioned and configured to substantially or entirely enclose the luggage piece. As a result, the corresponding luggage piece is protected from damage caused by outside forces, which commonly occur during handling of the luggage during travel and storage. In addition, unauthorized access to the luggage piece and the contents thereof is also significantly restricted.

Additional structural and operational features of the luggage protection assembly include the housing comprising oppositely disposed end portions and oppositely disposed side portions. Moreover, a first of the end portions is cooperatively structured to facilitate passage of the wheels, rolling members or other type of mobile support of the luggage piece therethrough. Such accessible accommodation of the mobile support with the first end portion facilitates positioning of the wheels or other rolling support of the luggage piece into movable engagement with the surface over which the housing and enclosed luggage piece travels. In cooperation therewith, a second or opposite one of the end portions is structured to provide access to one or more luggage handles typically located on a corresponding end of the luggage piece which is opposite to the mobile support. Therefore, the mobile luggage piece may be used in the intended and conventional fashion in terms of exerting a pulling or other propelling force thereon when the luggage piece is disposed within the protective housing.

The housing further includes an entrance in the form of an opening which, dependent on the preferred embodiment of the present invention utilized, may be located on or defined by different portions of the housing. In more specific terms, the entrance is dimensioned and configured to at least partially correspond to that of the luggage piece so as to facilitate the passage of the luggage piece into and out of the hollow interior in a manner which substantially or entirely encloses the luggage piece therein. Associated with the entrance, is the provision of a closure assembly movably connected to the housing and selectively positionable into and out of closing and/or covering relation to the entrance opening and, in most embodiments, to at least a corresponding portion of the luggage piece.

A lock assembly is mounted on and operatively associated with at least a portion of the closure assembly and is structured to restrict movement of the closure assembly out of the aforementioned closing and/or covering relation to the entrance. In at least one preferred embodiment of the present invention, the closure assembly comprises at least one but more practically a plurality of flaps movably connected to the housing in adjacent relation to the entrance opening. As such, the one or more flaps are individually or collectively dimensioned and configured to close and/or cover the entrance opening in overlying and possibly covering relation to the corresponding portion of the enclosed luggage piece. In cooperation therewith, the aforementioned lock assembly may assume a variety of different structural and operational features such as by being located on the exterior of one of the flaps and disposed to cooperate and/or at least partially mate with one or more of the other flaps in a manner which facilitates a locking engagement of the plurality of flaps thereby preventing access to the enclosed luggage piece. Alternatively, a lock assembly may include one or more lock segments or members cooperatively structured to interact with one another. Moreover in at least one embodiment, at least one of the lock structures or segments may interact with a locking mechanism associated with the luggage piece itself. Access to the luggage piece and/or its contents may thereby be prevented or at least substantially restricted utilizing any of a plurality of different "external locks" attached to one or more of the flaps. Such external lock structures may assume known or conventional operational features such as being in the form of a combination lock, key lock, etc.

Further with regard to the entrance opening, it may be located or be defined by one of the opposite end portions associated with or disposed in accessible relation to the extendible and other handle structures associated with the luggage piece. In this embodiment the opposite end portion associated with the wheel assembly or mobile rolling support of the luggage piece may include an apertured construction defined by a plurality of apertures aligned with and dimensioned to facilitate the passage therethrough of the rolling support. In such an instance, the first of the two opposite end portions is substantially closed, with the exception of the plurality of rolling support openings and the second end portion is open and associated with a plurality of movably connected flaps structured to accommodate access to one or more luggage handles.

In yet another embodiment, the first end portion may be defined by an open end which is also dimensioned and configured to define the entrance of the housing. Accordingly, the closure assembly comprising one or more flaps is connected in adjacent relation to the entrance opening of the first open end portion and selectively disposed into interlocking, overlapping engagement with one another so as to assume the closed relation to the entrance opening. Further, in this embodiment the plurality of flaps are cooperatively dimensioned with corresponding peripheral entrance opening portions, with which they are associated, to provide a plurality of rolling support openings. Moreover, these openings may be generally located at the corners of the entrance opening between adjacent ones of the plurality of flaps.

It is recognized that mobile luggage comes in a variety of different sizes and configurations. Accordingly, the housing may be structured to demonstrate sufficient versatility such that one or more portions thereof may define the aforementioned entrance opening. By way of example only, the housing may include at least one side panel movably connected along its outer periphery to the corresponding ones of the end and side portions of the housing and selectively disposed between open and closed positions. When in the open position, the entrance opening is correspondingly dimensioned and configured to the side panel and is defined by the opening created when the one side panel in the open position.

Similarly, the closure assembly may include at least one or a plurality of flaps movably connected to the housing and disposed in overlying relation to the side panel. Further, the overlapping flaps overlie and restrict access to the connection between the one side panel and the corresponding side and end portions. As will be explained in greater detail hereinafter, this protective positioning of the plurality of flaps allows the use of a zipper to connect the periphery of the one side panel in the closed position on the housing. It is commonly recognized that zippers are easy to access in terms of the unauthorized opening thereof without detection. In order to overcome such problems associated with the zipper type closures and allow the one side panel to be connected to the remainder of the housing using a zipper structure, the flaps can be disposed in the aforementioned protective overlapping position. More specifically, the plurality of flaps of the closure assembly may be disposed in overlapping relation to one another such that the zipper's closure is completely covered. Interlocking engagement of the plurality of flaps with one another and with the one side panel will serve to prevent access to the zipper closure thereby further restricting access to the luggage piece contained within the hollow interior.

At least one alternative embodiment of the present invention includes a composite luggage protection assembly comprising a luggage piece having a luggage protection assembly mounted or attached thereto, the luggage protection assembly being either removably mounted or integrally constructed therewith. The luggage piece includes a cover and an oppositely disposed base, and oppositely disposed sides and oppositely disposed ends cooperatively structured and disposed with the cover and the base to define an internal luggage space. The cover is movably mounted to one of the sides or one of the ends, and is disposable between an open orientation and a closed orientation relative to the internal luggage space.

In at least one embodiment of a composite luggage protection assembly, a primary closure mechanism is provided and is structured and disposed to selectively maintain the cover in a closed orientation. As noted above, a luggage protection assembly is mounted or attached to the luggage piece. In one embodiment, the luggage protection assembly comprises an external closure assembly disposable between an open configuration and a closed configuration, wherein the closed configuration is at least partially defined by the external closure assembly disposed in a covering relation to at least a portion of the primary closure mechanism, thereby preventing access into the luggage piece.

A locking assembly is provided in at least one embodiment of the present composite luggage protection assembly, wherein the locking assembly is structured and disposed to maintain the external closure assembly in a closed configuration relative to the cover, and more importantly, the primary closure mechanism of the cover.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

As represented in the accompanying figures, the present invention is directed to an assembly generally indicated as 10 structured to protect luggage such as, but not limited to, "mobile luggage". An example of a piece of mobile luggage is generally indicated as 100 and may include a movable support such as wheels, rollers or other rolling support members, generally indicated as 102. As is well known mobile luggage pieces may vary in size and configuration and accordingly may have a variety of differently placed or structured wheels or other rolling support members 102. The versatility of the luggage protection assembly 10 is such as to efficiently accommodate luggage pieces of varying sizes and shapes. Accordingly, the various embodiments of the luggage protecting assembly 10 of the present invention may come in a variety of different and possibly corresponding sizes and/or shapes so as to accommodate the different luggage styles, including both mobile and non-mobile luggage pieces.

Figure 1:
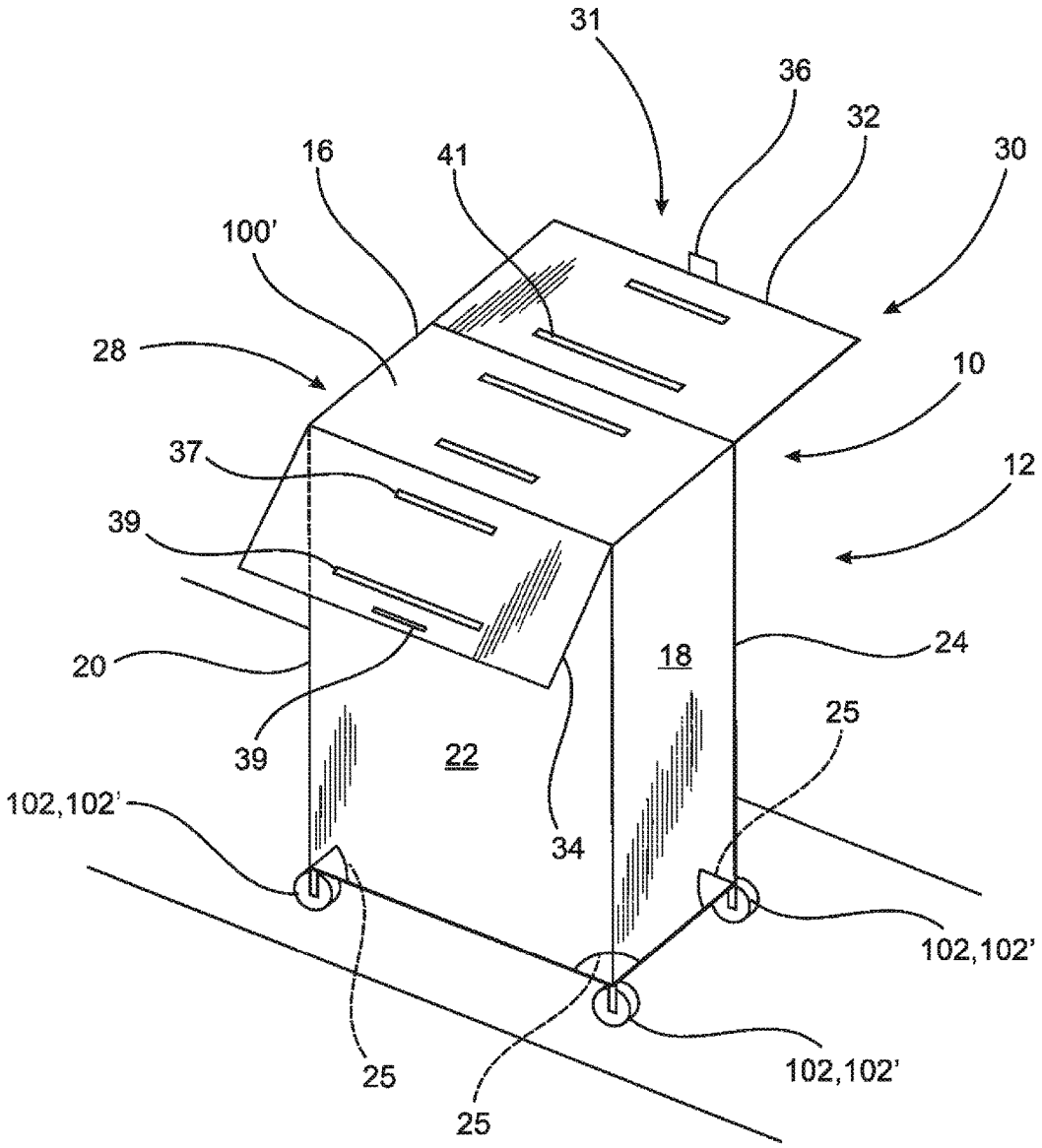
FIG. 1 is a perspective view of one preferred embodiment of the luggage protector assembly of the present invention wherein a piece of mobile luggage is disposed on the interior thereof.

With primary reference to one preferred embodiment of FIG. 1, the luggage protecting assembly 10 includes a housing generally indicated as 12 including opposite end portions 14 and 16 as well as oppositely disposed side portions 18 and 20. The side portions 18 and 20 are generally disposed in interconnecting relation between the end portions 14 and 16 and thereby collectively define the outer periphery of the body 12. The housing 12 may generally conform to the overall shape, size, etc. of the luggage piece 100 and therefore may also include oppositely disposed side panels 22 and 24.

As further represented in FIG. 1, the hollow interior of the housing may be correspondingly dimensioned and configured to the exterior dimensions and configurations of the luggage piece 100 being contained therein. Therefore, at least one of the opposite ends, such as a first opposite end 14, may be "closed" but structured to facilitate receipt and passage of the wheels or rolling support members 102 therethrough. As such, the one end portion 14 may include an "apertured construction" wherein a plurality of apertures 25 may be formed in the one or first closed end portion 14. Further, the one or more apertures 25 defining the apertured construction are disposed and dimensioned in at least partial alignment with corresponding ones of the rolling supports 102. As such, when the luggage piece 100 is placed within the hollow interior of the housing 12, the wheels, rollers or other rolling supports 102 may easily and efficiently pass through the apertures 25. The rolling members 102 are thereby disposed to access and engage a supporting surface 105 over which the housing 12 and the retained luggage piece 100 travels.

While the present invention is primarily described as a luggage protecting assembly 10 structured to protect a "mobile" luggage piece 100, it is emphasized that at least one embodiment may be used to protect a luggage piece that may not be "mobile" in the sense of not having a mobile support connected directly thereto. More specifically, one or more embodiments of the luggage protecting assembly 10 may include mobile support members 102' connected thereto, such as on a closed end 14. Therefore the rolling support members 102' enhance the versatility of the luggage protecting assembly 10 by enabling its use with a luggage piece which is absent the rolling support members 102 or where the location, size, configuration, etc., of existing roller support members 102 on the luggage piece 100 does coincide with the "apertured construction" in the manner described herein.

As also represented in FIG. 1, the body 12 includes an entrance opening generally indicated as 28 which is formed in the opposite or second end portion 16. Therefore this embodiment includes the opposite end portion 16 being "open" so as to define an entrance opening 28. Entrance opening 28 is sufficiently dimensioned and configured to allow passage of the luggage piece 100 therethrough into a retaining position within the hollow interior of the body 12. The entrance opening 28 is also directly associated with a closure assembly generally indicated as 30. More specifically, the closure assembly 30 comprises one or more flaps 32 and 34. Further, each of the plurality of flaps 32 and 34 are movably and/or pivotally connected to the body 12 substantially adjacent to the entrance opening 28 and the periphery of the second end portion 16. As such, the plurality of flaps 32 and 34 are individually and/or collectively dimensioned and configured to overlie an exposed end 100' or correspondingly positioned portion of the luggage piece 100, in a closing relation to the entrance opening 28. When in such a closing relation to the entrance opening 28, the plurality of flaps 32 and 34 are disposed in overlying, covering and protecting relation to the exposed end or surface 100' of the luggage piece 100.

In addition, a lock assembly 31 is mounted on or connected to the housing 12 preferably, but not exclusively, in direct association with the closure assembly 30. In more specific terms, the lock assembly 31 may include at least one lock member 36 secured to at least one of the plurality of flaps 32 and 34. In the embodiment of FIG. 1 the lock member or structure 36 is designed to cooperate with a lock member or structure 36' which may be directly attached to the luggage piece 100 being retained within the housing 12. Accordingly, flap 34 includes properly disposed openings as at 37 and 39 which facilitate access to the lock 36' as well as to one or more handles 40 mounted on or movably connected to the exposed or correspondingly positioned end or portion 100' of the luggage piece 100. When the flaps 32 and 34 of the entrance assembly 30 are in the closed position, flap 34 will be disposed in direct engaging relation to the end portion 100' and opening 37 will overly the luggage lock segment 36'. Once the flap 32 is disposed in overlying relation to the previously "closed" flap 34, the lock structure 36, connected to and movable with the flap 32, will then pass both through the opening 37 and into removable locking engagement with the luggage lock segment 36'. In turn, cooperatively disposed openings 39 and 41 respectively formed on the entrance flaps 34 and 32 are such that opening 39 will be aligned with the handle 40 and slot or opening 41 will be disposed in overlying, aligned relation to both the opening 39 and the handle 40 when the flaps 32 and 34 are in the closed orientation.

Figure 2:
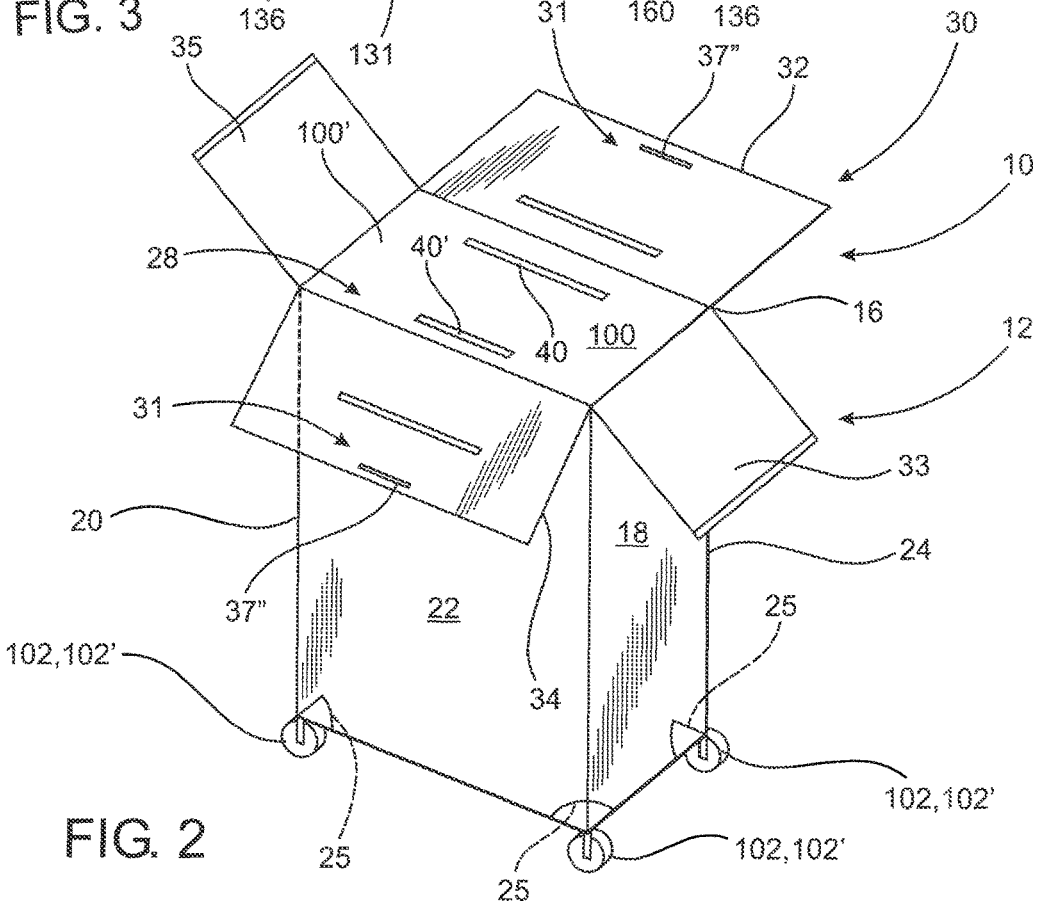
FIG. 2 is a perspective view of yet another preferred embodiment of the luggage protector assembly of the present invention similar to but distinguishable from the embodiment of FIG. 1.

In another preferred embodiment represented in FIG. 2 the body is also generally designated as 12. A comparison of FIGS. 1 and 2 will clearly indicate that the bodies 12 of both these embodiments may be similar at least in shape. As such, the body 12 of FIG. 2 also includes opposite end portions 14 and 16, wherein the first opposite end 14 is closed and includes an apertured construction at least partially defined by the openings or apertures 25 which allow passage therethrough of the wheels or other supports 102. In addition, both bodies 12 include side portions 18 and 20 as well as oppositely disposed side panels 22 and 24.

However, in the embodiment of FIG. 2 the closure assembly generally indicated as 30 includes a plurality of flaps 32 through 35 which differ in size, number and location from that of FIG. 1. More specifically, each of the flaps 32 through 35 are movably connected adjacent to the entrance opening 28 and are movably disposed into and out of closing relation to the entrance opening 28. In addition, a lock assembly 31 comprises one or more lock structures 37" directly associated with one or more of the flaps 32 through 35 in a manner which facilitates the overlapping or covering relation of each of the flaps relative to the exposed portion 100' of the luggage piece 100. Further, the plurality of flaps 32 through 35 are cooperatively dimensioned and disposed so as to overlap one another and/or the exposed portion 100' of the luggage piece 100 in a manner which collectively disposes the plurality of flaps 32 through 35 of the closure assembly 30 in closing relation to the entrance opening 28. Further, due to the additional opposing flaps 33 and 35, the dimension thereof may be somewhat shortened so as to not completely cover or overlap handle portions 40 and 40' of the luggage piece 100. As with the embodiment of FIG. 1 the other, corresponding flaps 32 and 34 have appropriate slots, 37, 39 and 41 which are disposable in aligned relation to one another when the flaps are in a closing relation to the entrance opening 28. This provides clear and easy access to the handles 40, 40'. As is well known in the mobile luggage industry, at least one of the handles such as at 40' may be extendable outwardly so as to facilitate the rolling or "pulling" of the luggage piece 100 by some or all of the rolling wheels or rolling supports 102. Further, when in closed relation to the entrance opening 28, the lock structures or segments 37" are positioned in aligned relation to one another so as to form an interconnecting, locking action. This locking action serves to restrict unauthorized access to the hollow interior of the body 12 and the luggage piece 100 contained therein.

Figure 3:
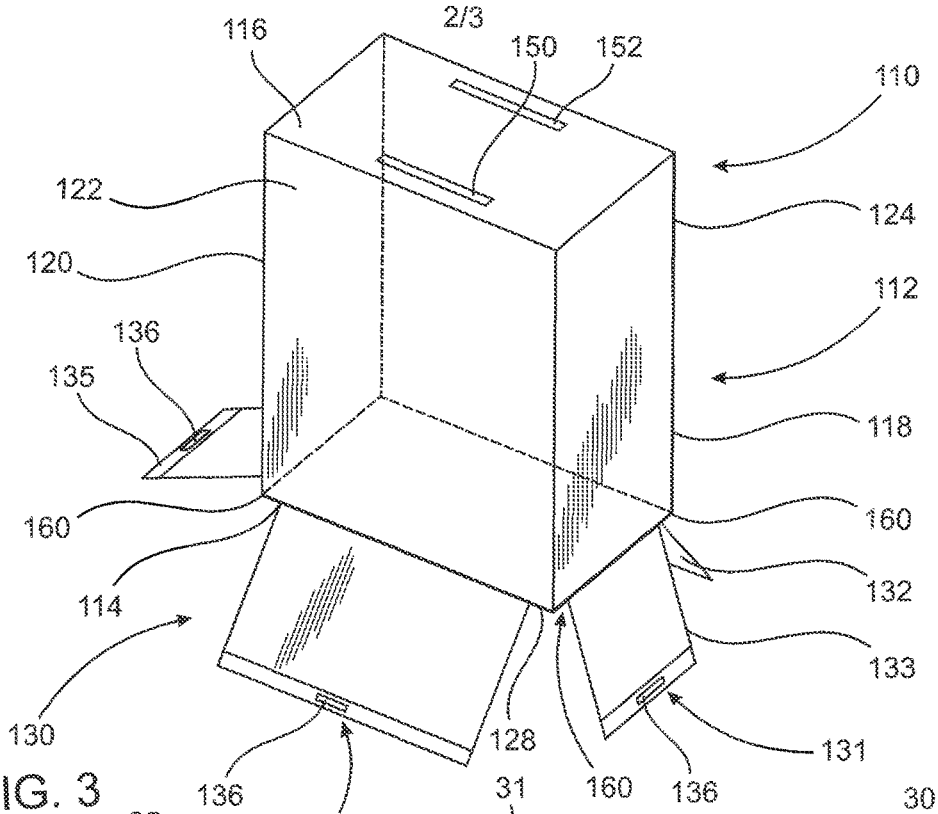
FIG. 3 is a perspective view of yet another preferred embodiment of the luggage protector assembly of the present invention.

As represented in FIG. 3 yet another embodiment of the luggage protecting assembly is generally indicated as 110 and includes a body 112 having a hollow interior which is dimensioned and configured to allow retention of a luggage piece (not shown) therein. In this embodiment, the body 112 includes the aforementioned opposite end portions 114 and 116 as well as oppositely disposed side portions 118 and 120. The body 112 also includes oppositely disposed side panels 122 and 124. In the additional preferred embodiment of FIG. 3, the first opposite end 114 has an open construction and thereby defines the entrance opening 128. The entrance opening 128 is of sufficient dimension and configuration to allow passage into the hollow interior of the body 112 of an appropriately sized and dimensioned piece of luggage. As set forth herein, the body 112 is specifically, but not exclusively, adapted to retain the mobile piece of luggage on the interior thereof. Accordingly, the second end portion 116 has a closed structure as clearly indicated. Appropriate slots or openings 150 and 152 are formed in the closed end portion 116 in order to provide clear and effective access to the one or more handles such as at 40 and 40' of the luggage piece 100, as describe with reference to FIG. 2.

The first open end 114 of the body 112 also includes a closure assembly generally indicated as 130, which is at least partially defined by a plurality of flaps 132, 133, 134, and 135. The flaps 132 through 135 are movably connected to the body 112 adjacent the entrance opening 128 and may be disposed in overlying, covering relation to any luggage piece contained therein and in closing relation to the entrance opening 128. Further, one or more of the flaps may include a lock assembly 131 directly associated therewith such that the flaps 132 through 135 are cooperatively dimensioned and configured so as to align locking structures or segments 136 with one another when the plurality of flaps are in a closed, overlying and/or covering relation to the entrance opening 128.

Further, in that the second opposite end 116 is closed, provision is made in the open opposite end 114 for the passage of a mobile support assembly or rolling support such as wheels 102 therethrough. This accommodation is made by shortening the transverse dimension of each of the flaps 132 through 135 so as to create an open space as at 160, preferably at the corners of the flaps and the entrance opening 128. Therefore, when the plurality of flaps 132 through 135 are disposed in closing relation relative to the entrance opening 128, open spaces 160 will be provided to facilitate the alignment, receipt and passage of the plurality of wheels and/or rolling supports 102 therethrough into an accessible relation with the surface over which the body 112 and any luggage piece contained therein is supported and/or transported.

Figure 4:
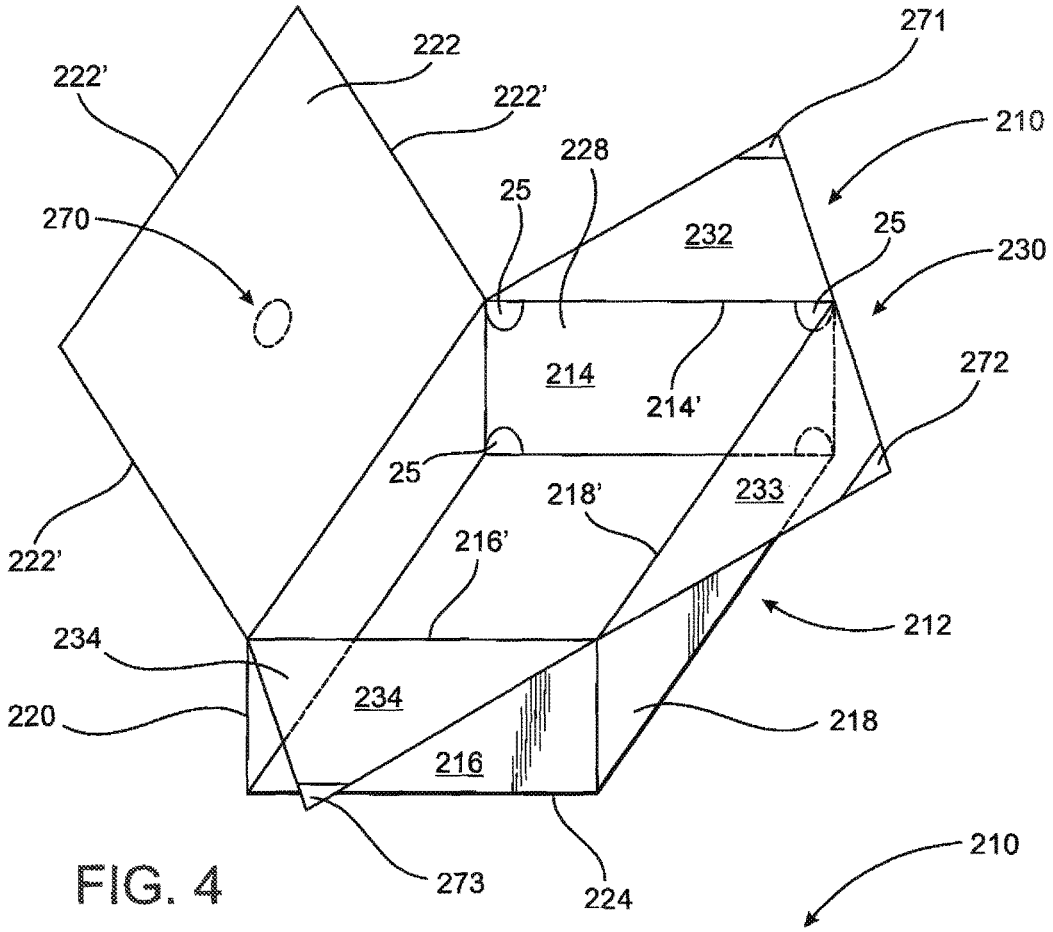
FIG. 4 is a perspective view of yet another preferred embodiment of the luggage protector assembly of the present invention in an open orientation.
Figure 5:
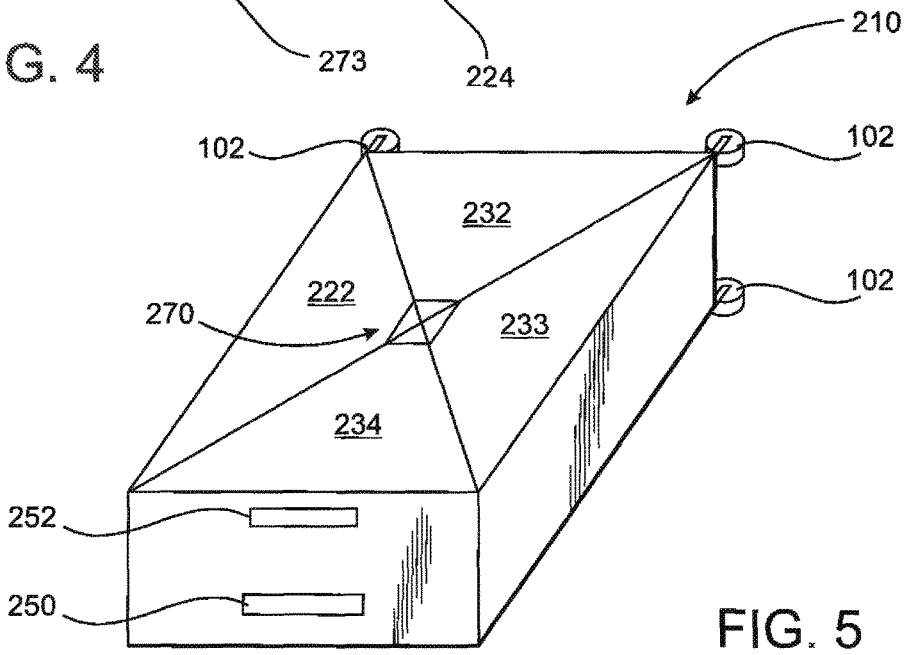
FIG. 5 is a perspective view of the embodiment of FIG. 4 in a closed orientation.

FIGS. 4 and 5 relate to yet another preferred embodiment of the present invention wherein the cover assembly is indicated as 210. As clearly represented, FIGS. 4 and 5 respectively represent the luggage protecting assembly 210 in open and closed positions. Accordingly, the embodiment 210 includes body 212 and opposite end portions 214 and 216. Also, opposite side portions 218 and 220 extend along the length of the body 212 and effectively interconnect the first and second end portions 214 and 216. Also, the oppositely disposed side panels 222 and 224 extend along the length of the body 212 and are effectively interconnected about the peripheries thereof to the opposite end portions 214, 216 as well as the opposite side portions 218, 220. Further, in the embodiment of FIGS. 4 and 5 the entrance opening 228 is defined or formed by a movable connection of the one side panel 222 to a remainder of the body 212. As such, the one panel 222 may be selectively disposed between the open position of FIG. 4 and the closed position of FIG. 5. Further, a closure assembly 230 comprises a plurality of panels 232 through 234 as well as the one side panel 222.

An additional feature of this preferred embodiment is the removable connection of the periphery 222' to the correspondingly disposed peripheries of the end and side portions 214, 218 and 216, as generally indicated at 214', 218' and 216'. It should therefore be apparent that the removable attachment of the one side panel 222 to the reminder of the body 212 in closing relation to the entrance opening 228 is accomplished by one or more zipper structures extending along the respective peripheries 222', 214', 218' and 216'.

It is further recognized that access to a zipper structure, especially relating to the unauthorized entry into the contents of luggage is easily accomplished. Therefore, the plurality of flaps 232 through 234 of the closure assembly 230 are disposed, dimensioned and configured to effectively cover the zipper structure serving to removably connect the one side panel 222 to the remainder of the body 212. Therefore, in the closed orientation of FIG. 5, the one side panel 222, which is also to be considered a part of the closure assembly 230, is connected in overlying, covering relation to the entrance opening 228 by activation or closing of the aforementioned zipper structure. Once in the closed orientation, various lengths or segments of the zipper structure are covered by the overlapping positioning of the flaps 232, 233 and 234 relative to corresponding portions of the first side panel's 222 corresponding zipper segments.

Further, a locking assembly is generally indicated as 270 and includes a plurality of lock segments 271, 272, 273 connected to appropriate portions of the respective panels 232 through 234. As such, the cooperative disposition of the locking assembly at 270 with the locking segments 271 through 273 facilitates a lock engagement of the plurality of panels 232 through 234 in overlapping relation to the one side panel 222 and in covering, protecting relation to corresponding segments of the zipper structure which serves to removably connect the periphery 222' of the one side panel 222 to the remainder of the body 212.

The embodiment of FIGS. 4 and 5 also includes appropriate apertures as at 25 for the passage of wheels or other rolling support therethrough once the luggage piece is disposed within the hollow interior of the body 212. Similarly, appropriate openings, slots as at 250 and 252 are provided to assure quick and easy access to one or both of one or more luggage handles mounted on an appropriate portion of the luggage piece retained within the hollow interior of the body 212.

It also emphasized that the various embodiments of the present invention are at least partially represented in FIGS. 1 through 5 in schematic form. Therefore, as set forth above, the luggage protection assembly 10, 110, 210, etc. defining the various preferred embodiments of the present invention comprises a housing and flaps, which may be formed from a flexible, semi-flexible, semi-rigid, or substantially rigid material.

Figure 6:
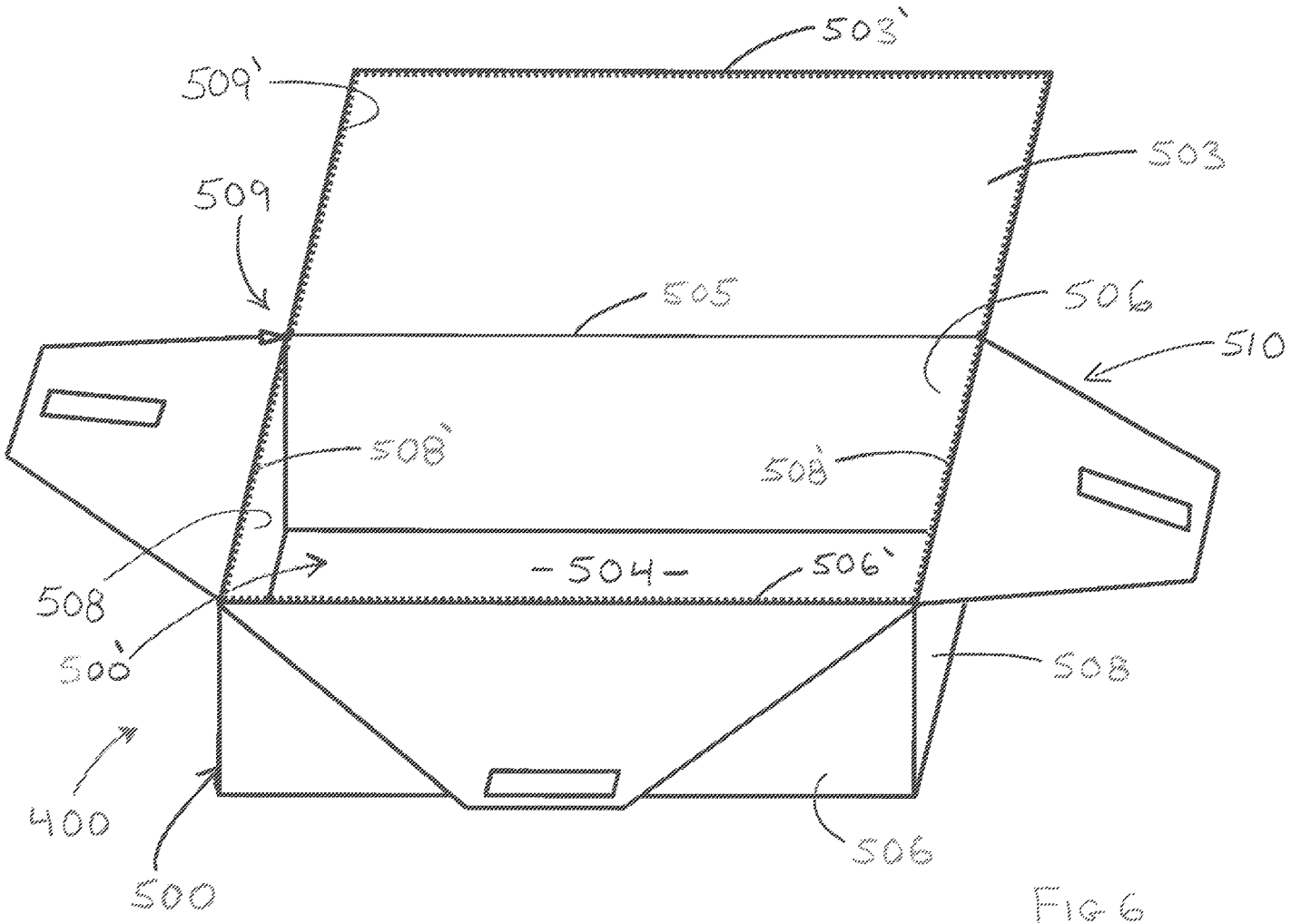
FIG. 6 is a perspective view of one alternate embodiment of the luggage protection assembly of the present invention mounted directly to a piece of luggage, wherein both the luggage piece and the luggage protection assembly are disposed in an open orientation.
Figure 7:
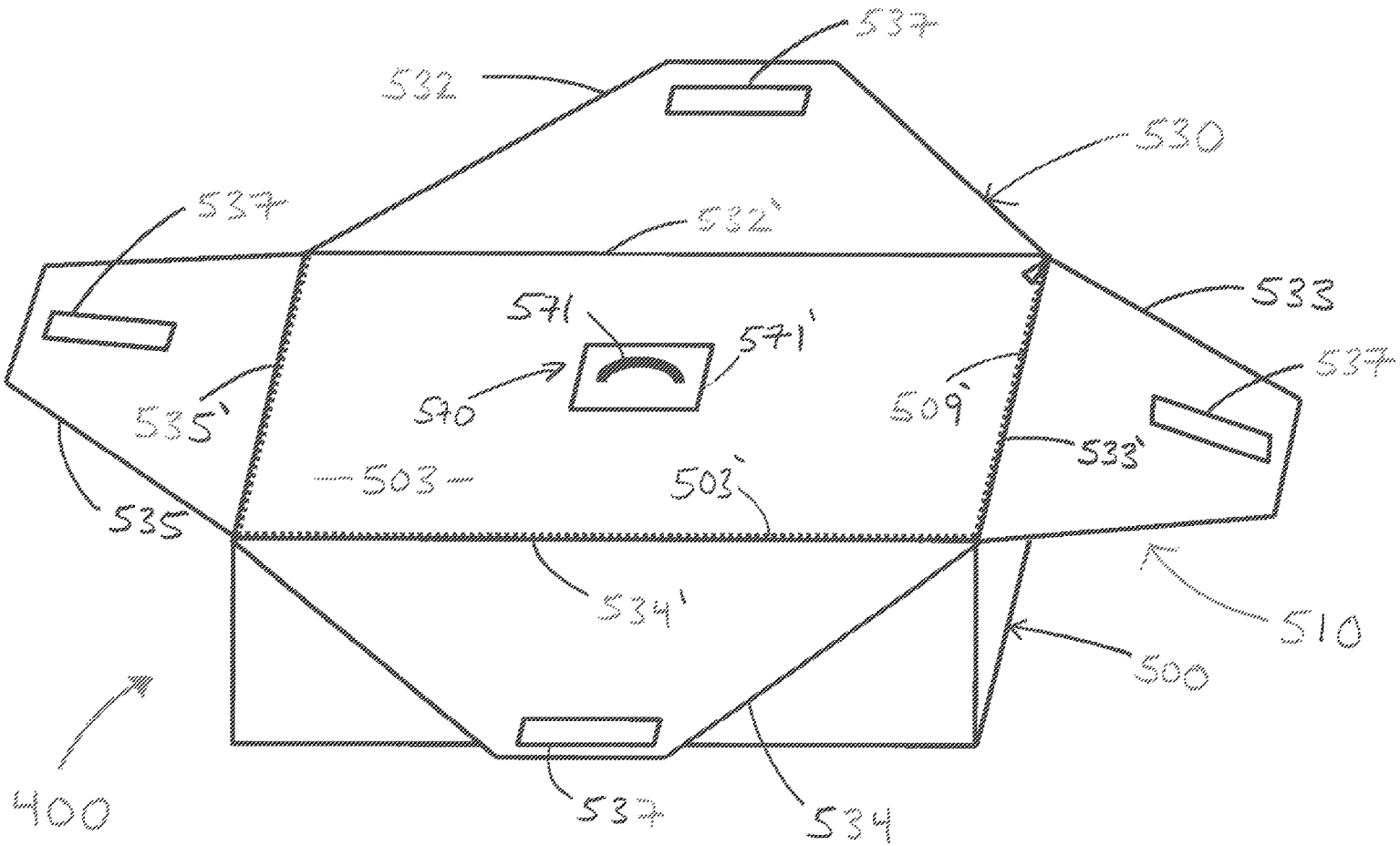
FIG. 7 is a perspective view of the alternate embodiment of the luggage protection assembly of FIG. 6 wherein the luggage piece is disposed in a closed orientation.
Figure 8:
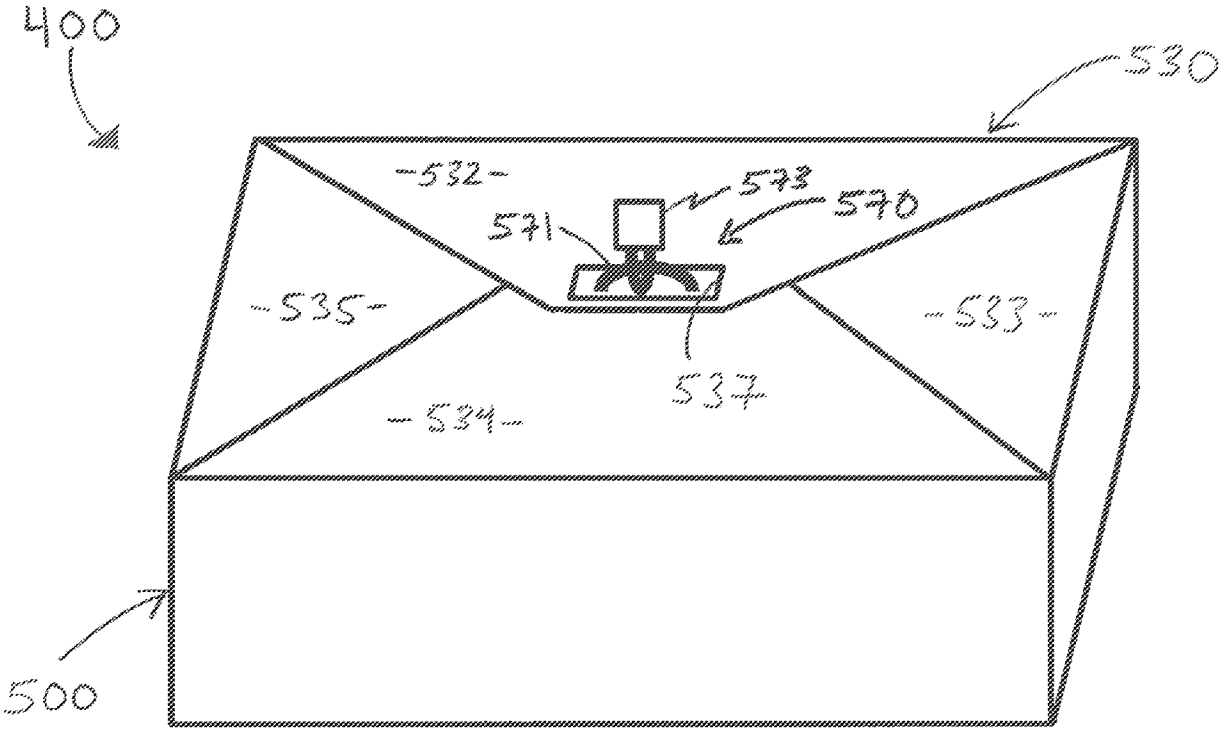
FIG. 8 is a perspective view of the alternate embodiment of the luggage protection assembly of FIG. 7 wherein both the luggage piece and the luggage protection assembly are disposed in a closed orientation.

FIGS. 6 through 8 are illustrative of one alternate embodiment of the luggage protection assembly of the present invention wherein a luggage protection assembly is mounted directly to a piece of luggage itself. Looking first to FIG. 6, a composite luggage protection assembly in accordance with the present invention is generally shown as at 400. As may be seen from FIG. 6, the composite luggage protection assembly 400 includes a luggage piece 500 having a cover 503 and a base 504 interconnected in spaced apart relation from one another by oppositely disposed sides 506 and oppositely disposed ends 508. As further seen from FIG. 6, the luggage piece 500 is structured to define an internal luggage space 500' in which a user may place his or her belongings for travel and/or storage.

FIG. 6 also shows one embodiment of a luggage protection assembly, generally shown at 510 and as described in greater detail hereinafter, being mounted directly to the luggage piece 500. In the illustrative embodiment of FIG. 7, the cover 503 of luggage piece 500 is movably attached to at least one of the oppositely disposed sides 506 via a cover hinge 505. Of course, it is understood to be within the scope and intent of the present invention for the cover 505 to be movably attached to the other side 506, one of the ends 508, and/or a portion of the base 504, via one or more cover hinge 505. Regardless, the cover 503 is movable between an open orientation and a closed orientation relative to the internal luggage space 500'.

FIG. 6 further illustrates primary closure mechanism, as generally shown at 509, which is structured and disposed to selectively maintain the cover 503 in the closed orientation relative to the internal luggage space 500'. In at least one embodiment, the primary closure mechanism 509 comprises a zipper structure 509' such as is shown in FIGS. 6 and 7. More in particular, the zipper structure 509' is disposed along an interface between the cover 503 and corresponding sides 506 and ends 508, respectively. As illustrated best in FIG. 6, the zipper structure 509' is disposed along an outer periphery 503' of the cover 503 which corresponds to peripheries 506' and 508' of the corresponding side 506 and ends 508, respectively, once again, as shown in FIG. 6. Turning to FIG. 7, it is seen that when cover 503 is disposed in a closed orientation the zipper structure 509' may be disposed in a zipped orientation along the outer periphery 503' of the cover 503 thereby maintaining the cover 503 in a closed orientation.

FIG. 7 is further illustrative of the composite luggage protection assembly 400 in accordance with the present invention having a luggage protection assembly 510 which is mounted directly to a luggage piece 500. More in particular, FIG. 7 is illustrative of an embodiment of a luggage protection assembly 510 comprising an external closure assembly generally shown at 530. Somewhat similar to the previously described embodiments of FIGS. 4 and 5, the external closure assembly 530 of the embodiment of FIG. 7 comprises a plurality of cooperatively structured flaps 532 through 535. FIG. 7 is illustrative of an embodiment of an external closure assembly 530 disposed in an open configuration relative to the cover 503 of the luggage piece 500 and more in particular, relative to zipper structure 509' operatively engaged therewith.

The external closure assembly 530 as shown in the illustrative embodiment of FIG. 8 is disposed in a closed configuration relative to the cover 503 (not shown) of the luggage piece 500. More in particular, FIG. 8 is illustrative of the composite luggage protection assembly 400 in accordance with the present invention wherein external closure assembly 530 is disposed in covering relation to at least a portion of the primary closure mechanism 509 (not shown) of the luggage piece 500.

FIG. 8 is further illustrative of a lock assembly 570 in accordance with at least one embodiment of the present invention. As shown in FIG. 8, lock assembly 570 comprises at least one locking structure 571, which, as illustrated, comprises a locking ring or house. FIG. 8 further illustrates lock assembly 570 comprising at least one mechanism 573 which, as shown in the illustrative embodiment of FIG. 8 comprising a separate detachable padlock type structure. Of course, it is well within the scope and intent of the present invention for locking mechanism 573 to be integrally constructed and mounted to a portion of the luggage piece 500, for example, a portion of the cover 503, or, to one of the plurality of flaps 532 through 535 of the external closure assembly 530. Looking once again to FIG. 7, in at least one embodiment, lock assembly 570 comprises a plurality of locking structures 571, 571'. As shown in the illustrative embodiment of FIG. 7, locking structure 571 comprises a locking ring or clasp, while locking assembly 571' comprises a mounting plate for attaching locking structure 571 to a portion of the cover 503 of the luggage piece 500. As best illustrated in FIG. 7, each of the plurality of flaps 532 through 535 comprises a locking aperture 537. As shown in FIG. 8, each locking aperture 537 is cooperatively oriented and dimensioned such that each is positioned over top of locking structure 571 when each of the plurality of flaps 532 through 535 is positioned in a closed disposition relative to zipper structure 509' (not shown). As noted above, FIG. 8 is illustrative of each of the plurality of flaps 532 through 535 of the external closure assembly 530 in a closed disposition relative to the cover 503 (not shown) and the primary closure mechanism 509 (not shown) of luggage piece 500.

Further, FIG. 8 illustrates the locking apertures 537 cooperatively oriented and disposed to permit locking structure 571 to pass therethrough while the corresponding flaps 532 through 535 are in the closed disposition. The lock assembly 570, and in particular locking mechanism 573 as shown in FIG. 8, is structured to releasably maintain each of the plurality of flaps 532 through 535 in the closed disposition while lock assembly 570 is disposed in a locking engagement with the external closure assembly 530, such as illustrated, by way of example, in FIG. 8.

As such, and as will be appreciated from the figures, and in particular FIG. 8, when the external closure assembly 530 is in a closed disposition and the lock assembly 570 is disposed in a locking engagement with the external closure assembly 530, access to the primary closure mechanism (not shown), and more importantly, access to the internal luggage space (not shown) and the user's belonging therein, is prevented.

Figure 9:
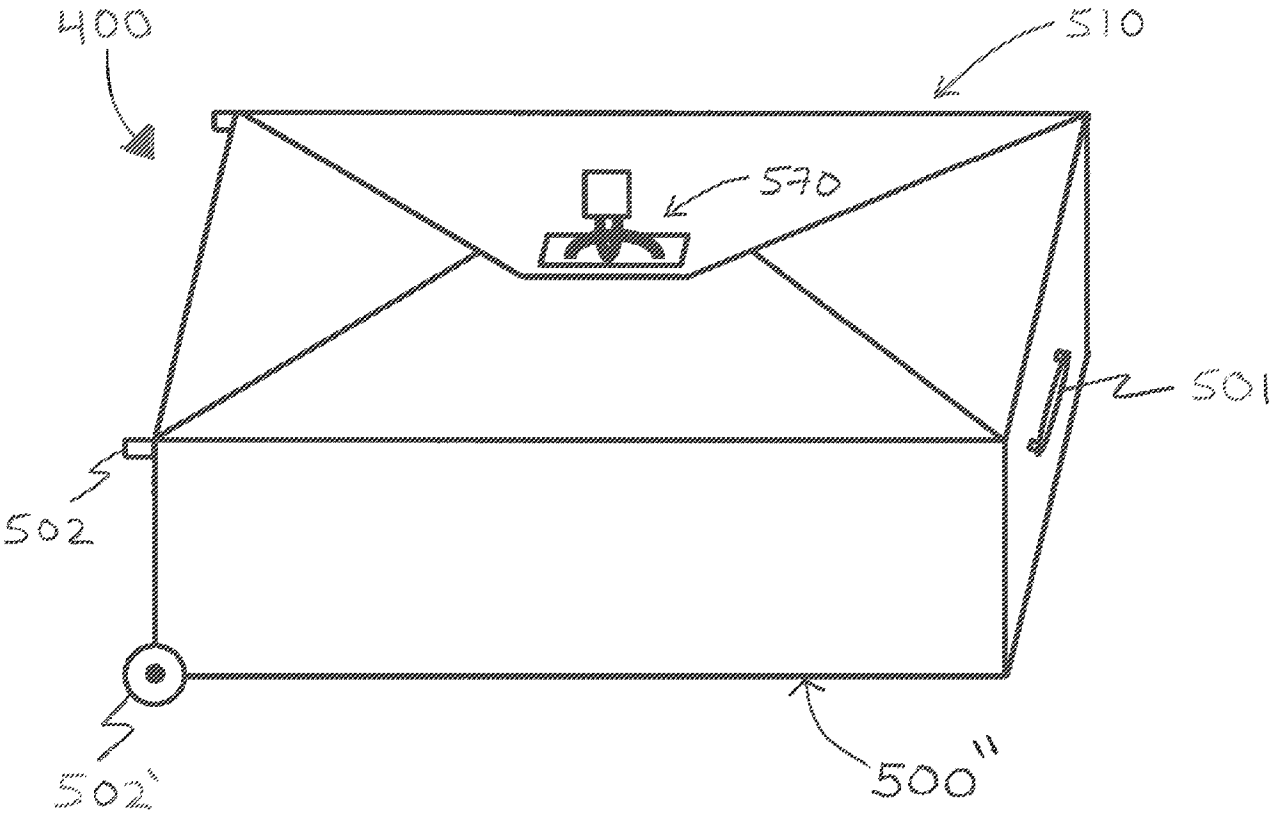
FIG. 9 is a perspective view of another alternate embodiment of the luggage protection assembly of the present invention mounted directly to a piece of mobile luggage, wherein both the mobile luggage piece and the luggage protection assembly are disposed in a closed orientation.

FIG. 9 is illustrative of one further embodiment of a composite luggage protection assembly 400 in accordance with the present invention. More in particular, FIG. 9 is illustrative of a composite luggage protection assembly 400 wherein the luggage protection assembly 510 is mounted to a mobile luggage piece 500". As may be seen from FIG. 9, mobile luggage piece 500" comprises at least one support member 502. In at least one embodiment, such as, by way of example only, the illustrative embodiment of FIG. 9, the mobile luggage piece 500" comprises a plurality of support members 502, 502' operatively attached to one and of mobile luggage piece 500". More in particular, FIG. 9 illustrates the mobile luggage piece 500" comprising at least one rolling support member 502' to facilitate movement of the mobile luggage piece 500" along and across a support surface, while fixed support member 502 facilitate disposition of the mobile luggage piece 500" in an upright stationary position while in storage and/or while not in transit.

The mobile luggage piece 500" of the embodiment of FIG. 9 further comprises a handle 501 which, as previously described herein, may be retractable within at least a portion of the mobile luggage piece 500" to facilitate storage and/or to stow the luggage while in transit. FIG. 9 is further illustrative of composite luggage protection assembly 400 having a luggage protection assembly 510 mounted to the mobile luggage piece 500" and a lock assembly 570 to maintain luggage protection assembly 510 in closed configuration relative to at least a portion of the mobile luggage piece 500".

As noted above with reference to FIG. 8, when luggage protection assembly 510 is disposed in a closed disposition relative to the cover (not shown) of luggage piece 500", and the lock assembly 570 is disposed in a locking engagement, access to the primary closure mechanism (not shown), and more importantly, access to the internal luggage space (not shown) and the user's belonging therein is, once again, prevented.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A composite mobile luggage protection assembly comprising:

a mobile luggage piece having a cover and an oppositely disposed base, said mobile luggage piece further comprising oppositely disposed sides and oppositely disposed ends, said sides and said ends cooperatively structured and disposed with said cover and said base to define an internal luggage space, said cover movably mounted to one of said sides or one of said ends, said cover disposable between an open orientation and a closed orientation relative to said internal luggage space, said mobile luggage piece comprising at least one support member mounted thereto, a primary closure mechanism structured and disposed to selectively maintain said cover in said closed orientation, said primary closure mechanism removably interconnecting said cover to at least portions of said sides and said ends while said cover is disposed in said closed orientation, a luggage protection assembly attached to said mobile luggage piece, wherein said luggage protection assembly comprises an external closure assembly disposable between an open configuration and a closed configuration, and said closed configuration at least partially defined by said external closure assembly disposed in a covering relation to at least a portion of said primary closure mechanism.

2. The assembly as recited in claim 1 further comprising a lock assembly structured to releasably retain said external closure assembly in said closed configuration.

3. The assembly as recited in claim 2 wherein said lock assembly comprises at least one locking structure mounted to said luggage piece and a locking mechanism selectively disposable into locking engagement with said at least one locking structure.

4. The assembly as recited in claim 2 wherein said external closure assembly comprises a plurality of flaps movably interconnected to said mobile luggage piece, each of said plurality of flaps disposable between an open disposition and a closed disposition.

5. The assembly as recited in claim 4 wherein said lock assembly comprises at least one locking structure mounted to at least one of said plurality of flaps and a locking mechanism selectively disposable and into locking engagement with said at least one locking structure.

6. The assembly as recited in claim 4 wherein said lock assembly releasably maintains each of said plurality of flaps in said closed disposition.

7. The assembly as recited in claim 6 wherein said lock assembly operatively engages at least one of said plurality of flaps and releasably maintains each of said plurality of flaps in said closed disposition.

8. The assembly as recited in claim 4 wherein said plurality of flaps are collectively dimensioned and disposed to substantially overly said cover when said external closure assembly is disposed in said closed configuration.

9. The assembly as recited in claim 4 wherein said primary closure mechanism comprises a zipper structure, said plurality of flaps disposed in an overlying protective relation to said zipper structure while in said closed disposition.

10. The assembly as recited in claim 1 wherein said mobile luggage piece comprises a plurality of support members mounted thereto.

11. The assembly as recited in claim 10 wherein at least one of said plurality of support members comprises a rolling support member.

12. The assembly as recited in claim 11 wherein said mobile luggage piece further comprises a handle.

13. The assembly as recited in claim 12 wherein said handle is retractable into at least a portion of said mobile luggage piece.

14. A composite mobile luggage protection assembly comprising:

a mobile luggage piece having a cover and an oppositely disposed base, said mobile luggage piece further comprising oppositely disposed sides and oppositely disposed ends, said sides and said ends cooperatively structured and disposed with said cover and said base to define an internal luggage space, said cover movably mounted to one of said sides or one of said ends, said cover disposable between an open orientation and a closed orientation relative to said internal luggage space, said mobile luggage piece comprising at least one support member mounted thereto, a primary closure mechanism comprising a zipper structure structured and disposed to selectively maintain said cover in said closed orientation, a luggage protection assembly attached to said mobile luggage piece, wherein said luggage protection assembly comprises an external closure assembly disposable between an open configuration and a closed configuration, a lock assembly structured to releasably retain said external closure assembly in said closed configuration, said external closure assembly comprising a plurality of flaps movably interconnected to said mobile luggage piece, each of said plurality of flaps disposable between an open disposition and a closed disposition, said plurality of flaps disposed in an overlying protective relation to said zipper structure while in said closed disposition, and said closed configuration at least partially defined by said external closure assembly disposed in a covering relation to at least a portion of said primary closure mechanism.

15. The assembly as recited in claim 14 wherein said lock assembly operatively engages at least one of said plurality of flaps to maintain each said plurality of flaps in said closed disposition.

* * * * *